United States Patent [19]

Beelaard et al.

[11] 4,409,578

[45] Oct. 11, 1983

[54] COLOR DISPLAY TUBE COMPRISING A DEFLECTION YOKE AND DEFLECTION YOKE FOR A COLOR DISPLAY TUBE

[75] Inventors: Wilhelmus A. J. Beelaard; Nicolaas G. Vink, both of Eindhoven, Netherlands

[73] Assignee: U.S. Philips Corporation, New York, N.Y.

[21] Appl. No.: 199,791

[22] Filed: Oct. 23, 1980

[30] Foreign Application Priority Data

Nov. 1, 1979 [NL] Netherlands ..... 7908000

[51] Int. Cl.[3] ..... H01F 7/00

[52] U.S. Cl. ..... 335/210; 335/212

[58] Field of Search ..... 335/210, 212, 213

[56] References Cited

U.S. PATENT DOCUMENTS

| | | | |
|---|---|---|---|
| 4,109,220 | 8/1978 | Peart | 335/212 |
| 4,231,009 | 10/1980 | Barkow | 335/212 |
| 4,246,560 | 1/1981 | Shimizu et al. | 335/212 |

*Primary Examiner*—George Harris

*Attorney, Agent, or Firm*—Thomas A. Briody; William J. Streeter

[57] ABSTRACT

A color display tube having three electron guns situated in one plane for emitting three electron beams towards a display screen and having a deflection device which is mounted around a neck portion of the display tube and has a deflection yoke comprising: an annular core of a magnetizable material on which a field deflection coil toroidally is wound in such manner that its turns are located in planes passing through the longitudinal axis of the annular core. A dipolar field is generated in combination with a sixpole field resulting in a pin-cushion shaped overall field. To change the field at the rear end from the core from pin-cushion to barrel shape on the inside of the rear end of the annular core members of a magnetically permeable material are provided symmetrically with respect to the axis of the field deflection field. Blocks of ferrite provided adjacent the rear end of the annular core and placed opposite to each other on the axis of the field deflection magnetic field enhance the effect of the magnetically permeable members. This configuration corrects east-west raster distortions while maintaining good self-converging properties of the display tube-deflection yoke combination.

10 Claims, 8 Drawing Figures

COLOR DISPLAY TUBE COMPRISING A DEFLECTION YOKE AND DEFLECTION YOKE FOR A COLOR DISPLAY TUBE

The invention relates to a colour display tube having three electron guns situated in one plane for emitting three electron beams towards a display screen and having a deflection device which is mounted around a neck portion of the display tube and has a deflection yoke comprising a substantially cylindrical core of a magnetisable material the diameter of which at one end is smaller than that at the other end, a first deflection coil for generating, upon energization, a line deflection magnetic field, and a second deflection coil for generating, upon energization, a field deflection magnetic field, which second deflection coil consists of two substantially symmetrical coil halves which are axially wound and which are provided toroidally on the core. The invention also relates to a deflection yoke for such a combination.

BACKGROUND OF THE INVENTION

For some time colour television display tubes have been used in which the three spatially separated electron guns are situated on one line. Such a display tube is known as an in-line colour display tube. In the in-line colour display tube it is usual to use a deflection yoke with deflection coils which give such an inhomogeneous field distribution that the beams of the electron guns upon deflection coincide all over the screen. For that purpose the line deflection magnetic field on the cup side of the deflection yoke (the side which corresponds to the end of the core having the larger diameter) must be pin-cushion-shaped and the field deflection magnetic field must be barrel-shaped on the neck side (the side which corresponds to the end of the core having the smaller diameter) and conversely.

The extent of pin-cushion-shape and barrel-shape is such that convergence errors of the electron beams emitted by the electron guns are corrected, so that pictures with satisfactory convergence properties are produced on the screen of the display tube. Display tube/deflection yoke combinations of this type are termed self-converging.

When the convergence is ensured in this manner, it often appears to be necessary to correct a pin-cushion distortion (east-west raster distortion) occurring on the vertical sides of the display screen.

SUMMARY OF THE INVENTION

It is the object of the present invention to provide a deflection yoke for a cathode-ray tube with which east-west raster distortions can be reduced to within acceptable limits in a simple manner while maintaining the self-converging properties.

The invention provides a deflection yoke of the type disclosed in the opening paragraph which is characterized in that the second deflection coil has a winding distribution for generating a field deflection magnetic field of substantially pin-cushion shape throughout the length of the core, while a device is provided which, at the end of the core having the smaller diameter, changes the magnetic field of the second deflection coil from pin-cushion to barrel shape.

It has been found that a straight east-west raster can be obtained in principle by laying the wire distribution of the frame deflection coil so that in addition to the overall dipolar field needed for the deflection of the electron beams a sixpole field deflection magnetic field is produced exclusively on the screen side of the deflection yoke. This sixpole field gives rise to a local pin-cushion-shaped modulation of the dipolar field on the screen side which corrects the undesired pin-cushion-like east-west raster distortion inherent to dipolar field deflection magnetic field.

However, in deflection yokes having a field deflection coil wound toroidally on the core, the simplicity of the above solution is interfered with. If for the sake of simplicity such a field deflection coil is wound axially on its core, in which the deflection coil, for generating the required sixpole field, consists of two halves each enveloping an angle between 70° and 90°, that sixpole field is produced not only on the screen side, but throughout the length of the yoke, so also on the neck side. A pin-cushion-like modulation of the field deflection magnetic field would then also occur on the neck side, whereas for a good convergence a barrel-shaped field configuration is necessary at that area. According to the invention this barrel-shaped field configuration is realized by means of the device which changes the magnetic polefield of the field deflection coil on the neck side from pin-cushion into barrel shape.

The device which locally changes the shape of the field of the field deflection coil may comprise two members of magnetically permeable material which are provided substantially parallel to the direction of the field deflection magnetic field, symmetrically with respect to the axis thereof, inside the core adjacent the end having the smaller diameter.

The use of the two above-described members of magnetically permeable material which may be constructed, for example, as curved plates of a silicon-iron alloy material the curvature complying with the curvature of the ring core, in the sensitivity of the field deflection system being decreased. In some cases this may be a disadvantage. To mitigate this disadvantage the device may further comprise two blocks of magnetically permeable material placed diametrically opposite to each other on the axis of the field deflection magnetic field, which blocks are situated in the regions of stray magnetic field produced by the second deflection coil at the end of the core having the smaller diameter.

The use of two blocks of magnetically permeable material (for example, ferrite) which thus are placed on the "east" and "west" positions on the neck side of the ring core in the regions of stray magnetic field of the field deflection coil have a dual effect. Firstly, they make the field deflection magnetic field on the neck side more barrel-shaped, so that the dimensions of the members of magnetically permeable material placed in the deflection field can be smaller so that the loss of sensitivity thus becomes smaller than in the case without extra blocks. Secondly, since the blocks serve as poleshoes, they make the path of the field deflection magnetic flux through the air smaller, so that the sensitivity increases relative to the case without blocks.

The invention is not restricted to the use of (ferrite) blocks placed on the outside of the core. The blocks may also be formed as two regions which are integrally thickened on the neck side of the core, which, in the case in which the length of the core remains unvaried, has for its advantage that the field deflection point is not further moved towards the smaller end of the core, as is the case when separate ferrite blocks are used which are placed against that end of the core. (In other words, the shape of the dipolar field deflection magnetic field is not varied thereby).

The use of the separate blocks has the advantage that the blocks, when they are supported so that they can be moved in the radial direction, can also provide line symmetry control and/or field balance control. This is of practical use, in particular, in those cases in which it is not possible to perform these controls by means of a movement of the relative position of the core on the display tube, as in systems in which the core has a fixed position on the display tube.

BRIEF DESCRIPTION OF THE DRAWINGS

The invention will now be described in greater detail, by way of example, with reference to the accompanying drawings, in which.

DETAILED DESCRIPTION OF THE PREFERRED EMBODIMENTS

In-line colour television display tubes are display tubes of the type in which an electron gun configuration is placed in the neck part to produce three electron beams situated in one plane and in which recurring groups of blue, red and green phosphor dots or lines are provided on the screen part in front of a shadow mask. An envelope has a cone portion varying from narrow to wide between the neck part and the screen part.

Figure 1:
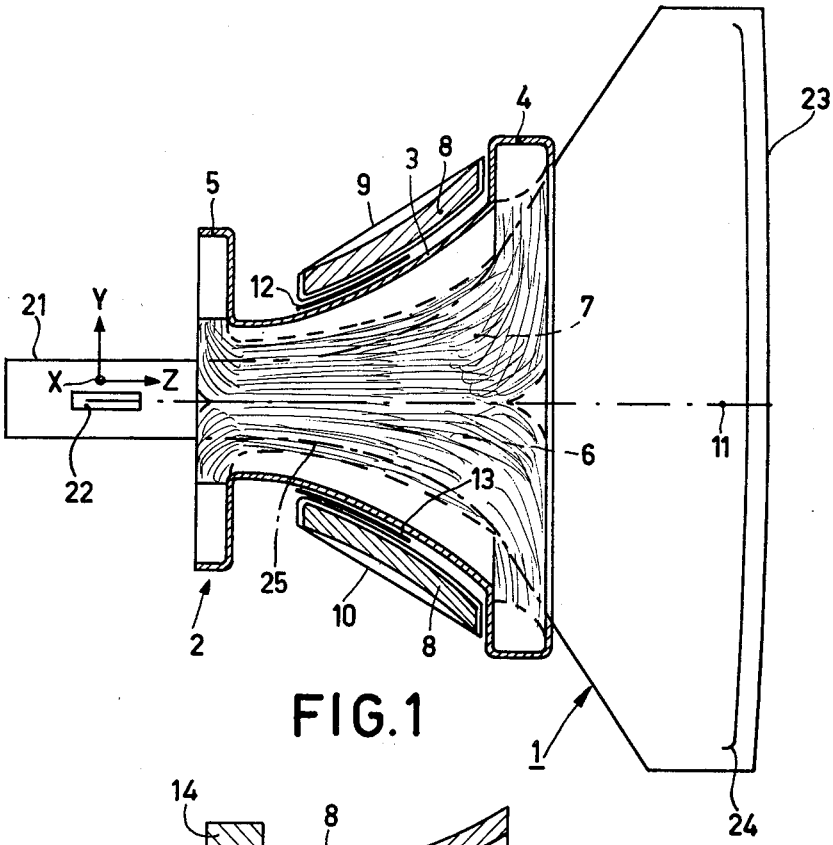
FIG. 1 is a diagrammatic cross-sectional view (taken along the Y-Z plane) of a deflection yoke according to the invention mounted on a colour television display tube with means influencing the field deflection magnetic field.

With reference to FIG. 1, a deflection yoke 2 for such a display tube 1 comprises a cap or support 3 of insulating material having a front upright end 4 and possibly a rear upright end 5. Between these ends 4 and 5 are present on the inside of the cap 3 two line deflection coil halves 6 and 7 and on the outside of the cap 3 an annular core 8 of magnetisable material on which a field deflection coil consisting of two oppositely located halves 9 and 10 is wound toroidally.

The two halves 6 and 7 of the line deflection coil are of the saddle type with two (front and rear) upright ends. However, they may also be of the type having only a front upright end, so that the upright rear end 5 of the cap 3 may be omitted and the use of an undivided annular core 8 becomes possible.

Figure 3A:
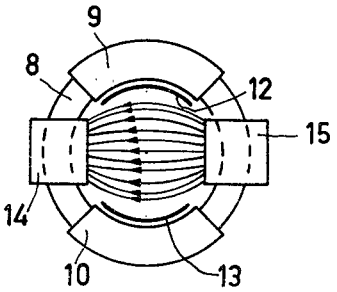
FIG. 3*a* is a rear view of the magnetic core of FIG. 2.
Figure 3B:
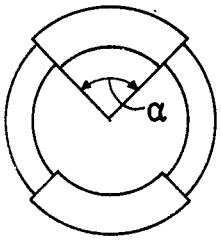
FIG. 3*b* is a rear view of the magnetic core of FIG. 2 which shows only the field coil halves.

The two halves 9 and 10 of the field deflection coil are wound axially on the annular core 8, i.e. the turns are located in planes which pass through the tubular axis 11 of the core. The distribution of the turns is such that a dipolar magnetic field in combination with a sixpole magnetic field is produced throughout the length of the field deflection coil, the combination resulting in an overall magnetic field of pin-cushion shape. (In the case, for example, of a deflection yoke for a 20 inch 90° display tube this is realized by constructing each field deflection coil half as a multi-layer single-wire axially wound toroidal coil in which each layer consists of 75 turns each coil half occupying an angular amount $\alpha$ of between 70° and 90° (compare FIGS. 3*a* and 3*b*).) As explained above, east-west raster distortion can be considerably corrected, it is true, in this manner, but the quality of the convergence is interfered with. For good convergence (astigmatic level) a field directed sixpole magnetic field of barrel shape is required, this being the required variation of the field deflection magnetic field on the neck side, while with the above-described wire distribution a field directed sixpole magnetic field of pin-cushion shape is generated everywhere, so that at the neck side a pin-cushion variation of the field deflection magnetic field is also produced. In order to make the field directed sixpole field on the neck side sufficiently barrel shaped, the deflection yoke 2 is provided with members 12 and 13 of magnetizable material (for example cut from a sheet of a silicon-iron alloy). The members 12 and 13 are mounted on the outside of the support 3 near the neck side of the field deflection coil halves 6 and 7. A characteristic thickness of these members is 0.5 to 1 mm with a length and width of a few cm.

Figure 2:
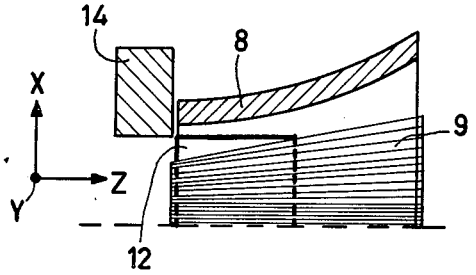
FIG. 2 is a partial cross-sectional view (along the X-Z plane) of the magnetic core of the deflection yoke of FIG. 1 which shows a deflection coil half and means to influence the field deflection magnetic field.

The location and size of the members 12 and 13 is indicated with reference to that of member 12 in FIG. 2.

However, the use of such members affect the sensitivity of the field deflection coil, because they locally attract and reduce the magnetic field. If one does not want to make concessions on the sensitivity, which may be reduced by a few %, then further steps can be taken to provide a solution. This comprises the provision of two blocks of ferrite (block 14 being shown in FIG. 2) against the end face (rear side) of the annular core 8. The location of the blocks 14 and 15 is shown clearly in FIG. 3*a* which is a rear view of the annular core 8. Also shown is the desired barrel-shaped variation of the field deflection magnetic field on the neck side, for which the members 12 and 13 are responsible in the first instance.

Figure 4:
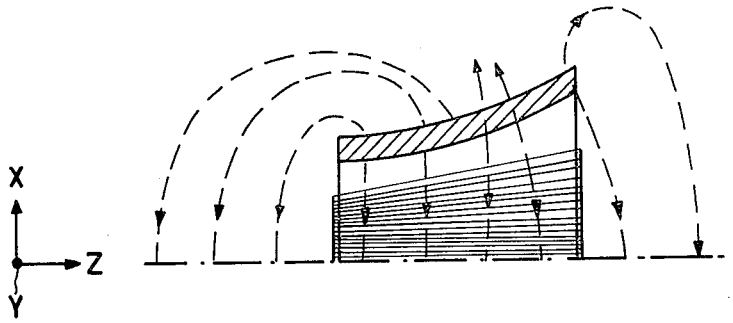
FIG.4 PRIOR ART
FIG. 4 is a partial cross-sectional view (along the X-Z plane) of a conventional magnetic core with field coil which shows the cariation of the field lines of the field deflection magnetic field.
Figure 5:
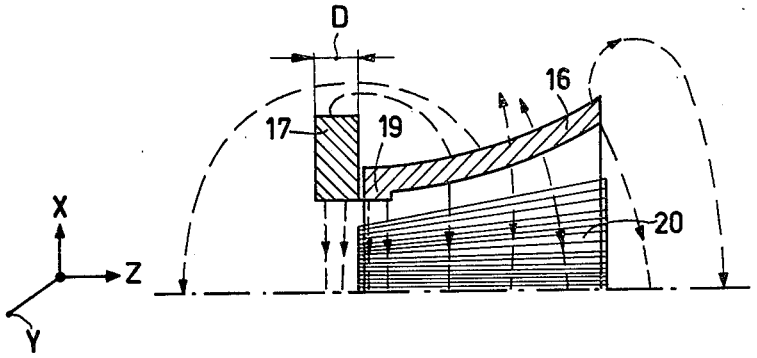
FIG. 5 is a partial cross-sectional view (along the X-Z plane) of a magnetic core with field coil which shows an embodiment of the invention and the influence which it has on the variation of the field lines of the field deflection magnetic field.

The effect of the ferrite blocks will be readily seen by a comparison of FIGS. 4 and 5. FIG. 4 shows the variation of the deflection field of a field deflection coil when ferrite blocks are not present. FIG. 5 shows the variation of the deflection field of a field deflection coil 20 wound on a ring core 16 in the case in which two diametrically positioned blocks are present with a thickness D of approximately 5 mm of ferrite (only block 17 is actually shown). A part of the (stray) field is captured and takes part in the deflection. Since in this case the air path for the field flux is smaller than in the case shown with reference to FIG. 4, the sensitivity increases. In addition, the blocks of ferrite make the field deflection field on the neck side more barrel-shaped, so that smaller members may be used than in the case without ferrite blocks, and the loss of sensitivity thus is less. The total improvement of the sensitivity which can be achieved in this manner is approximately 1 W (at 25 kV). An alternative possibility is to construct the rear end of the annular core 16 with two local thickenings. A thickening (19) may or may not be combined with a separate block (17).

Figure 6:
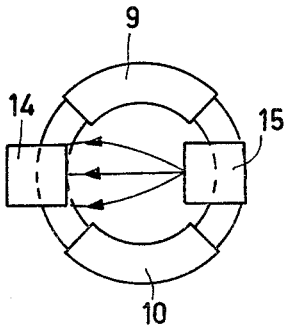
FIG. 6 is a rear view of a magnetic core with the field influencing means which, as compared with the situation shown in FIG. 3*a*, are both moved to the left, and in which the variation of the field-deflection magnetic field is shown.
Figure 7:
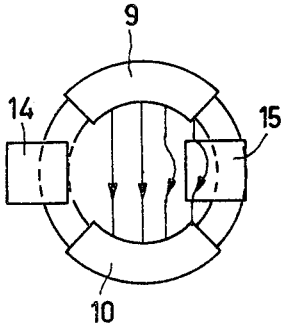
FIG. 7 is a rear view of the magnetic core of FIG. 6 in which the variation of the line deflection magnetic field is shown.

The use of separate blocks which are supported so as to be movable radially makes it possible to remove or reduce asymmetries in the field deflection coil halves arising during the manufacture or assembly (picture symmetry control). For this purpose the blocks 14 and 15 should be moved in the same direction (FIG. 6). Simultaneously, an influence of the line deflection field occurs (FIG. 7: line symmetry control).

What is claimed is:

1. A color display tube having three electron guns situated in one plane for emitting three electron beams towards a display screen and having a deflection device which is mounted around a neck part of the display tube and also having a deflection yoke comprising a substantially cylindrical core of a magnetizable material the diameter of which at one end is smaller than that at the other end, a first deflection coil for generating, upon energization, a line deflection magnetic field, and a second deflection coil for generating, upon energization, a field deflection magnetic field, which second deflection coil consists of two substantially symmetrical coil halves which are axially wound and which are provided toroidally on the core, each of said second deflection coil halves occupying an angular amount on said core of between 70° and 90°, said second deflection coil having a winding distribution for generating a field deflection magnetic field of substantially pin-cushion shape throughout the length of the core, a first deflection device provided at the end of said core having the smaller cross-section, said first device changing the magnetic field of the second deflection coil from pin-cushion to barrel-shape, said first device comprising two members of magnetically permeable material which are provided substantially parallel to the direction of the field deflection magnetic field, symmetrically with respect to the axis thereof, inside said core adjacent the end having the smaller diameter, and a second deflection device comprising two blocks of magnetically permeable material placed diametrically opposite to each other on the axis of the field deflection magnetic field, which blocks are situated in the regions of stray magnetic field produced by said second deflection coil at the end of said core having said smaller diameter.

2. A color display tube having three electron guns situated in one plane for emitting three electron beams towards a display screen and having a deflection device which is mounted around a neck part of the display tube and also having a deflection yoke comprising a substantially cylindrical core of a magnetizable material the diameter of which at one end is smaller than that at the other end, a first deflection coil for generating, upon energization, a line deflection magnetic field, and a second deflection coil for generating, upon energization, a field deflection magnetic field, which second deflection coil consists of two substantially symmetrical coil halves which are axially wound and which are provided toroidally on the core, said second deflection coil having a winding distribution for generating a field deflection magnetic field of substantially pin-cushion shape throughout the length of the core, a first deflection device provided at the end of said core having the smaller cross-section, said first device changing the magnetic field of the second deflection coil from pin-cushion barrel-shape, said first device comprising two members of magnetically permeable material which are provided substantially parallel to the direction of the field deflection magnetic field, symmetrically with respect to the axis thereof, inside said core adjacent the end having the smaller diameter, and a second deflection device comprising two blocks of magnetically permeable material placed diametrically opposite to each other on the axis of the field deflection magnetic field, which blocks are situated in the regions of stray magnetic field produced by said second deflection coil at the end of said core having said smaller diameter.

3. A color display tube as claimed in claim 1 or 2, wherein said blocks of magnetically permeable material are moveable in the radial direction perpendicular to the display tube axis.

4. A color display tube having three electron guns situated in one plane for emitting three electron beams towards a display screen and having a deflection device which is mounted around a neck part of the display tube and also having a deflection yoke comprising a substantially cylindrical core of a magnetizable material the diameter of which at one end is smaller than that at the other end, a first deflection coil for generating, upon energization, a line deflection magnetic field, and a second deflection coil for generating, upon energization, a field deflection magnetic field, which second deflection coil consists of two substantially symmetrical coil halves which are axially wound and which are provided toroidally on the core, each of said second deflection coil halves occupying an angular amount on said core of between 70° and 90°, said second deflection coil having a winding distribution for generating a field deflection magnetic field of substantially pin-cushion shape throughout the length of the core, a deflection device provided at the end of said core having the smaller cross-section, said deflection device changing the magnetic field of the second deflection coil from pin-cushion to barrel-shape, said deflection device comprising two members of magnetically permeable material which are provided substantially parallel to the direction of the field deflection magnetic field, symmetrically with respect to the axis thereof, inside said core adjacent the end having the smaller diameter, said end of said core having the smaller diameter having two regions which are internally thickened, which regions are situated opposite to each other on the axis of the field deflection magnetic field.

5. A color display tube having three electron guns situated in one plane for emitting three electron beams towards a display screen and having a deflection device which is mounted around a neck part of the display tube and also having a deflection yoke comprising a substantially cylindrical core of a magnetizable material the diameter of which at one end is smaller than that at the other end, a first deflection coil for generating, upon energization, a line deflection magnetic field, and a second deflection coil for generating, upon energization, a field deflection magnetic field, which second deflection coil consists of two substantially symmetrical coil halves which are axially wound and which are provided toroidally on the core, said second deflection coil having a winding distribution for generating a field deflection magnetic field of substantially pin-cushion shape throughout the length of the core, a first deflection device provided at the end of said core having the smaller cross-section, said first device changing the magnetic field of the second deflection coil from pin-cushion to barrel-shape, said first device comprising two members of magnetically permeable material which are provided substantially parallel to the direction of the field deflection magnetic field, symmetrically with respect to the axis thereof, inside said core adjacent the end having the smaller diameter, said end of said core having the smaller diameter having two regions which are internally thickened, which regions are situated opposite to each other on the axis of the field deflection magnetic field.

6. A deflection yoke adapted to be mounted on a neck portion of a cathode-ray tube, comprising a substantially cylindrical core of a magnetizable material the diameter of which at one end is smaller than that at the other end, a first deflection coil for generating, upon energization, a line deflection magnetic field, and a second deflection coil for generating, upon energization, a field deflection magnetic field, which second deflection coil consists of two substantially symmetrical coil halves which are axially wound and provided toroidally on the core, each of said second deflection coil halves occupying an angular amount on said core of between 70° and 90°, said second deflection coil having a winding distribution for generating a field deflection magnetic field of substantially pin-cushion shape throughout the length of the core, a first deflection device provided at the end of said core having the smaller diameter, said first device changing the magnetic field of the second deflection coil from pin-cushion to barrel shape, said first device comprising two members of magnetically permeable material which are provided substantially parallel to the direction of the field deflection magnetic field, symmetrically with respect to the axis thereof, inside said core adjacent the end having the smaller diameter, a second deflection device comprising two blocks of magnetically permeable material placed diametrically opposite to each other on the axis of the field deflection magnetic field, which blocks are situated in the regions of stray magnetic field produced by said second deflection coil at the end of said core having said smaller diameter.

7. A deflection yoke adapted to be mounted on a neck portion of a cathode-ray tube, comprising a substantially cylindrical core of a magnetizable material the diameter of which at one end is smaller than that at the other end, a first deflection coil for generating, upon energization, a line deflection magnetic field, and a second deflection coil for generating, upon energization, a field deflection magnetic field, which second deflection coil consists of two substantially symmetrical coil halves which are axially wound and provided toroidally on the core, said second deflection coil having a winding distribution for generating a field deflection magnetic field of substantially pin-cushion shape throughout the length of the core, a first deflection device provided at the end of said core having the smaller diameter, said first device changing the magnetic field of the second deflection coil from pin-cushion to barrel shape, said first device comprising two members of magnetically permeable material which are provided substantially parallel to the direction of the field deflection magnetic field, symmetrically with respect to the axis thereof, inside said core adjacent the end having the smaller diameter, a second deflection device comprising two blocks of magnetically permeable material placed diametrically opposite to each other on the axis of the field deflection magnetic field, which blocks are situated in the regions of stray magnetic field produced by said second deflection coil at the end of said core having said smaller diameter.

8. A deflection yoke as claimed in claim 6 or 7, wherein said blocks of magnetically permeable material are moveable in the radial direction perpendicular to the cathode-ray tube axis.

9. A deflection yoke adapted to be mounted on a neck portion of a cathode-ray tube, comprising a substantially cylindrical core of a magnetizable material the diameter of which at one end is smaller than that at the other end, a first deflection coil for generating, upon energization, a line deflection magnetic field, and a second deflection coil for generating, upon energization, a field deflection magnetic field, which second deflection coil consists of two substantially symmetrical coil halves which are axially wound and provided toroidally on the core, each of said second deflection coil halves occupying an angular amount on said core of between 70° and 90°, said second deflection coil having a winding distribution for generating a field deflection magnetic field of substantially pin-cushion shape throughout the length of the core, a deflection device provided at the end of said core having the smaller diameter, said deflection device changing the magnetic field of the second deflection coil from pin-cushion to barrel shape, said deflection device comprising two members of magnetically permeable material which are provided substantially parallel to the direction of the field deflection magnetic field, symmetrically with respect to the axis thereof, inside said core adjacent the end having the smaller diameter, said end of said core having the smaller diameter having two regions which are internally thickened which regions are situated opposite to each other on the axis of the field deflection magnetic field.

10. A deflection yoke adapted to be mounted on a neck portion of a cathode-ray tube, comprising a substantially cylindrical core of a magnetizable material the diameter of which at one end is smaller than that at the other end, a first deflection coil for generating, upon energization, a line deflection magnetic field, and a second deflection coil for generating, upon energization, a field deflection magnetic field, which second deflection coil consists of two substantially symmetrical coil halves which are axially wound and provided toroidally on the core, said second deflection coil having a winding distribution for generating a field deflection magnetic field of substantially pin-cushion shape throughout the length of the core, a deflection device provided at the end of said core having the smaller diameter, said deflection device changing the magnetic field of the second deflection coil from pin-cushion to barrel shape, said deflection device comprising two members of magnetically permeable material which are provided substantially parallel to the direction of the field deflection magnetic field, symmetrically with respect to the axis thereof, inside said core adjacent the end having the smaller diameter, said end of said core having the smaller diameter having two regions which are internally thickened which regions are situated opposite to each other on the axis of the field deflection magnetic field.

* * * * *